US005205227A

United States Patent [19]

Khinkis et al.

[11] Patent Number: 5,205,227

[45] Date of Patent: * Apr. 27, 1993

[54] PROCESS AND APPARATUS FOR EMISSIONS REDUCTION FROM WASTE INCINERATION

[75] Inventors: Mark J. Khinkis, Morton Grove; Hamid A. Abbasi, Darien, both of Ill.

[73] Assignee: Institute of Gas Technology, Chicago, Ill.

[ * ] Notice: The portion of the term of this patent subsequent to Jun. 4, 2008 has been disclaimed.

[21] Appl. No.: 703,812

[22] Filed: May 21, 1991

Related U.S. Application Data

[63] Continuation-in-part of Ser. No. 486,065, Feb. 28, 1990, Pat. No. 5,020,456.

[51] Int. Cl.[5] ..... F23J 11/00

[52] U.S. Cl. ..... 110/345; 110/244; 110/245

[58] Field of Search ..... 110/244, 245, 345

[56] References Cited

U.S. PATENT DOCUMENTS

| | | | |
|---|---|---|---|
| 3,781,162 | 12/1973 | Rudd et al. . | |
| 3,938,449 | 2/1976 | Frisz et al. . | |
| 3,955,909 | 5/1976 | Craig et al. . | |
| 4,013,399 | 3/1977 | Craig et al. . | |
| 4,050,877 | 9/1977 | Craig et al. . | |
| 4,336,469 | 6/1982 | Wysk . | |
| 4,416,418 | 11/1983 | Goodstine et al. | 110/245 |
| 4,538,529 | 9/1985 | Temelli | 110/244 |
| 4,589,353 | 5/1986 | Bauver, II | 110/244 |
| 4,624,192 | 11/1986 | Mansfield | 110/245 |
| 4,628,833 | 12/1986 | O'Hagan et al. | 110/245 |
| 4,646,661 | 3/1987 | Roos et al. | 110/245 |
| 4,672,900 | 6/1987 | Santalla et al. . | |
| 5,020,456 | 6/1991 | Khinkis et al. | 110/345 |
| 5,105,747 | 4/1992 | Khinkis et al. | 110/345 |

FOREIGN PATENT DOCUMENTS

| | | |
|---|---|---|
| 1010722 | 5/1977 | Canada . |
| 3915992 | 11/1989 | Fed. Rep. of Germany . |

OTHER PUBLICATIONS

Japanese Abstract 61-22115. "Combustion Controlling Method Utilizing Combustion Exhaust Gas." *Patent Abstracts of Japan.* vol. 10, No. 171 (M-489) (2227), Jun. 17, 1986.

German Reference 1 019 788. "Zweitluftzufuhrung mit Rauchgas-Rucksauge-Geblase fur eine Uberschubfeuerung." Nov. 21, 1957.

*Primary Examiner*—Henry C. Yuen

*Attorney, Agent, or Firm*—Speckman & Pauley

[57] ABSTRACT

A process for combustion of the combustible material includes introducing the combustible material into the combustion chamber, advancing the combustible material through the combustion chamber, supplying combustion air to the combustion chamber for drying and partially combusting the combustible material and final ash burnout in a primary combustion zone, and removing ash products from the combustion chamber. The fuel or fuel/carrier fluid mixture is supplied into the combustion chamber to create an oxygen deficient secondary combustion zone for $NO_x$ reduction and other nitrogen bearing compounds decomposition. An oxidizing fluid is supplied into the combustion chamber above the oxygen deficient secondary combustion zone for thorough mixing with combustion products and at least partial burnout of combustibles in an oxidizing tertiary combustion zone. A furnace for combustion in accordance with this process is also disclosed wherein a combustion chamber is configured such that combustible material can be advanced from a drying zone, to a combustion zone, to a burnout zone, and then into an ash pit. An air source provides air for drying, combustion and burnout in a primary combustion zone. Fuel or a fuel/carrier fluid mixture is injected above the primary combustion zone to create an oxygen deficient secondary combustion zone, to reduce $NO_x$ and decompose other nitrogen bearing compounds entering the secondary combustion zone. An oxidizing fluid is injected into the combustion chamber above the oxygen deficient secondary combustion zone.

30 Claims, 1 Drawing Sheet

PROCESS AND APPARATUS FOR EMISSIONS REDUCTION FROM WASTE INCINERATION

CROSS REFERENCE TO RELATED APPLICATION

This application is a continuation-in-part of copending U.S. patent application Ser. No. 07/486,065 filed Feb. 28, 1990, now U.S. Pat. No. 5020456.

BACKGROUND OF THE INVENTION

1. Field of the Invention

This invention relates to a process and apparatus for combustion of waste such as municipal solid waste (MSW), refuse derived fuel (RDF) or other comparable solid waste; the process results in simultaneous reduction in nitrogen oxides ($NO_x$), carbon monoxide (CO), total hydrocarbons (THC), dioxins (PCDD), furans (PCDF), and other organic emissions.

2. Description of the Prior Art

Most of the existing processes and apparatuses for combustion of waste include a combustion chamber equipped with a sloped or horizontal stoker grate that reciprocates or travels to move the waste from the waste inlet side of the combustor to the ash removal side of the combustor. A portion of the combustion air, generally equivalent to 1.0 to 1.3 of the waste stoichiometric requirement, is supplied under the stoker grate. Such combustion air is typically called undergrate air, or UGA, and is distributed through the stoker grate to dry and burn the waste present on the stoker grate. The waste is first dried on the drying portion or drying grate of the stoker grate, then combusted on the combustion portion or combustion grate of the stoker grate. The residual waste that primarily includes ash and carbon is then decarbonized or burned on the burnout portion or burnout grate of the stoker grate. The bottom ash is then removed through an ash pit. To assure carbon burnout, a high level of excess air, compared to the amount required for carbon burnout, is maintained at the burnout grate. In addition to other species, the products of waste drying, combustion and burnout contain products of incomplete combustion (PIC's) such as carbon monoxide (CO) and total hydrocarbons (THC), oxides of nitrogen (NO ), such as NO, $NO_2$, $N_sO$ and other nitrogen bearing compounds such as $NH_3$, HCN and the like.

The majority of $NO_x$ evolved from the stoker grate is believed to form from the oxidation of nitrogen bearing compounds and a smaller portion forms from the oxidation of molecular nitrogen.

Additional air or overfire air is usually introduced above the stoker grate and mixed with the products evolved from the stoker grate to burn out the combustibles. The excess air level downstream of the overfire air injection is generally in the range of 60% to Nitrogen bearing compounds that evolve from the waste react with oxygen in and downstream of the overfire air injection zone, forming significant additional $NO_x$. Because of the low combustion temperatures in and downstream of the overfire air injection, most of the $NO_x$ formed in this zone is by the oxidation of nitrogen bearing compounds (less than about 10% are formed in this zone by the oxidation of molecular nitrogen). Based on measurements by the inventors, typical mass burn operations would result in about 30% of the total $NO_x$ formed on the stoker and about 70% in and downstream of the overfire air injection.

In most cases, a boiler is an integral part of the combustor to recover the heat generated by MSW combustion. In some cases, cooled flue gases from downstream of the boiler are recirculated back into the combustion zone to reduce oxygen concentration and to lower combustion temperatures and thus are believed to decrease oxides of nitrogen formation. A disadvantage of flue gas recirculation (FGR) is generally a higher concentration of products of incomplete combustion within the flue gases and within the stack gases because of reduced combustion efficiency.

U.S. Pat. No. 3,781,162 teaches an apparatus for mixing recirculated flue gases with combustion air before the gases reach an igniter. The '162 patent discloses combustion without recirculating vitiated air from over a burnout grate for overfiring. The '162 patent teaches neither fluid swirling in the combustion chamber nor injecting fuel above a stoker grate.

U.S. Pat. No. 3,938,449 discloses a waste disposal facility which uses a rotary kiln that differs from a stoker. The rotary kiln includes a hollow, open-ended circular tube body mounted for rotation about its circular axis. Hot flue gases are recirculated to dehydrate the waste material and remove oxygen. The '449 patent does not disclose fluid swirling in the combustion chamber or fuel injection downstream of the primary waste combustion zone.

U.S. Pat. No. 4,336,469 teaches a method of operating a magnetohydrodynamic (MHD) power plant for generating electricity from fossil fuel. The MHD combustor has a first stage which operates substoichiometrically, second stage natural gas injection, and third stage air injection for complete combustion. The '469 patent does not disclose the use of vitiated air from the combustor for overfiring and does not disclose fluid swirling within the combustion chamber. The '469 patent discloses a dwell chamber downstream of the MHD generator for reducing nitrogen oxides, but does not disclose nitrogen bearing compound decomposition.

U.S. Pat. No. 4,672,900 teaches a tangentially-fired furnace having injection ports for injecting excess air above a fireball of the combustion chamber to eliminate the flue gas swirl as the flue gas flows into a convection section. The furnace uses pulverized coal as a fuel. Secondary air is tangentially injected into the furnace and swirls in the direction opposite of the flue gas swirl. The '900 patent does not suggest the use of recirculated vitiated air from the main combustor for overfiring, fluid swirling within the combustion chamber, or fuel injection downstream of the primary combustion zone.

U.S. Pat. Nos. 4,013,399, 4,050,877 and 3,955,909 teach reduction of gaseous pollutants in combustion flue gas. The '909 patent discloses two-stage combustion within a combustion chamber. Heat removal occurs in the first, second or both combustion stages to reduce nitrogen oxides. Secondary combustion air is injected or diffused through tubes into the stream of gaseous combustion products flowing from a primary combustion chamber to promote mixing and complete combustion without an excessive amount of secondary air.

SUMMARY OF THE INVENTION

It is an object of this invention to provide a process and apparatus for combustion of combustible materials such as MSW, RDF or other comparable solid combustible material where fuel, preferably natural gas, is injected above the burning combustible material providing a sufficient temperature, from about 1600° F. to about 2400° F., and a sufficient length of time, from about 1.0 sec to about 4.0 sec, to create a secondary combustion zone in which nitrogen bearing compounds entering the secondary combustion zone are decomposed to $N_2$ and secondary combustion air or overfire air injected above the secondary combustion zone is used to reduce other emissions such as carbon monoxide (CO), total hydrocarbons (THC), dioxins (PCDD), and dibenzofurans (PCDF), without forming significant additional $NO_x$.

It is another object of this invention to inject a carrier fluid, such as steam, water, nitrogen and/or recirculated flue gases from the boiler exit into the secondary combustion zone to enhance mixing, and improve temperature and composition uniformity in the secondary combustion zone.

It is another object of this invention to remove a portion of the combustion products from above the burnout grate or from above the burnout zone, which normally enter the secondary combustion zone, to increase temperature and improve temperature and composition uniformity in the secondary combustion zone, to decrease the necessary amount of fuel, to reduce $NO_x$ emissions and to improve combustible burnout in a tertiary combustion zone downstream of the secondary combustion zone.

It is another object of this invention to provide a process and apparatus for combustion of solid combustible materials using a combination of low excess air or substoichiometric combustion of solid combustible materials in certain zones within the combustion chamber above the drying and primary combustion zones, using flue gas recirculation or other carrier fluid upstream and/or downstream of the combustion chamber, using fuel injection or injection of a mixture of fuel and recirculated flue gases or other carrier fluid to provide a secondary combustion zone downstream of the primary combustion zone or above the burning combustible material for decomposing nitrogen bearing compounds and $NO_x$, and using secondary combustion air or overfire air injection above the secondary combustion zone for final burnout of remaining combustibles in a tertiary combustion zone.

It is another object of this invention to remove a significant portion of the combustion products, or vitiated air, from above or downstream of the burnout zone and mix it with fresh air and/or oxygen for reinjection downstream of the secondary combustion zone.

It is yet another object of this invention to provide a process and apparatus for combustion of solid combustible materials where recirculated flue gases or another carrier fluid are injected downstream of the primary combustion zone, or above the stoker grate, into the secondary combustion zone which thus creates turbulent flow for enhanced mixing, nitrogen bearing compounds decomposition and $NO_x$ reduction. Decomposition of nitrogen bearing compounds and $NO_x$ reduction is further enhanced by tangentially injecting fuel, a fuel/recirculated flue gas mixture, a fuel/other carrier fluid mixture, recirculated flue gases or other carrier fluid above the stoker grate to create multiple swirl zones. Similarly, combustible burnout is increased by tangentially injecting oxidant downstream of the secondary combustion zone.

These objects are accomplished in accordance with one embodiment of this invention in which combustible material is injected into a plurality of walls which define a combustion chamber of a stoker-type furnace having at least one drying grate, at least one combustion grate and at least one burnout grate. At least one ash pit is located downstream of the burnout grate, within the combustion chamber. Integral to the furnace and disposed downstream of the stoker grate is a boiler or other heat recovery device in which heat in the flue gases is used for generating steam or providing thermal energy for some other process.

At least one combustible material inlet is located in at least one wall of the combustion chamber in a position such that the combustible material is introduced into the combustion chamber onto the drying grate. At least one conduit is in communication with a primary combustion air or undergrate air source and a space beneath the grates. Primary combustion air injected into the combustion chamber from beneath the grates is used to 1) dry the combustible material on the drying grate, 2) combust the dried combustible material which has been moved by combustible material advancement means from the drying grate to the combustion grate to form a primary combustion zone immediately above the combustion grate, and 3) burn out any uncombusted material remaining in the ash from the combustion grate which has been moved by combustible material advancement means onto the burnout grate. Ash from the burnout grate is deposited into the ash pit. Through an opening in a wall of the combustion chamber, a fuel and/or a carrier fluid such as steam, water, nitrogen or recirculated flue gases from the boiler or heat recovery section of the furnace is introduced into the combustion chamber directly above the primary combustion zone, forming a secondary combustion zone. Oxygen concentrations within this secondary combustion zone are maintained below a level which promotes the formation of $NO_x$; that is, the secondary combustion zone is an oxygen deficient zone with respect to nitrogen, including nitrogen in nitrogen bearing compounds, in the zone. In this zone, nitrogen bearing compounds from the primary combustion zone are decomposed, significantly reducing the amount of $NO_x$ produced in the oxygen deficient secondary combustion zone. Through still another opening in a wall of the combustion chamber, overfire air comprising at least one of vitiated air withdrawn from above the burnout grate in the combustion chamber and fresh air is introduced into the combustion chamber directly above the oxygen deficient secondary combustion zone forming an oxidizing tertiary combustion zone. Combustion of carbon monoxide, hydrogen, unburned hydrocarbons and other combustibles entering this zone from the oxygen deficient secondary combustion zone is completed in this oxidizing tertiary combustion zone. Using the process and apparatus of this invention, $NO_x$ in the flue gases is reduced by about 50% to about 70%.

In a preferred embodiment of this invention, fluids injected into the oxygen deficient secondary and oxidizing tertiary combustion zones are injected through nozzles positioned in a wall of the combustion chamber such that the fluids are injected into the combustion chamber tangentially with respect to the combustion chamber walls. In yet another preferred embodiment of the invention, the fluids are injected tangentially or radially into the combustion chamber at an angle with respect to the horizontal.

In one embodiment of this invention, mounted within an opening formed in a combustion chamber wall, preferably above the burnout grate, is a fan, blower, compressor or other type of air moving or compressing apparatus inlet through which vitiated air from above the burnout grate is withdrawn, compressed and reinjected through a nozzle into the combustion chamber above the oxygen deficient secondary combustion zone, forming an oxidizing tertiary combustion zone. In another embodiment of the invention, the vitiated air is mixed with fresh air or industrial grade oxygen from a nitrogen/oxygen separator and then injected into the combustion chamber. In still another embodiment, only fresh air or industrial grade oxygen is injected into the combustion chamber above the oxygen deficient secondary combustion zone, forming an oxidizing tertiary combustion zone.

The amount of overfire air, that is, vitiated air and/or fresh air or industrial grade oxygen, injected into the combustion chamber to form an oxidizing tertiary combustion zone is an amount sufficient to provide about 3% to about 12% oxygen concentration within the oxidizing tertiary combustion zone.

In one preferred embodiment according to this invention, the average oxygen level, relative to fuel and combustible materials in the combustion chamber, in the oxygen deficient secondary combustion zone is an amount equivalent to about 0.6 to about 1.3 of a stoichiometric requirement for complete combustion of said fuel and combustible materials. In another preferred embodiment, the oxygen concentration downstream of the overfire air inlet is about 3% to about 12%. In yet another preferred embodiment, flue gases are recirculated for drying and preheating the combustible material.

In another embodiment of this invention, fuel is injected within the combustion chamber, above the stoker grate, to provide an oxygen deficient secondary combustion zone for decomposing nitrogen-bearing compounds as well as reducing $NO_X$ in the combustion products entering the oxygen deficient secondary combustion zone. The fuel, which does not contain significant quantities of fuel-bound nitrogen, can be in a solid, liquid or gaseous form. A preferred fuel is natural gas. The fuel injected into the combustion chamber above the stoker grate represents about 5% to about 40% of the combustible material heating value. The fuel is injected above the stoker grate into the oxygen deficient secondary combustion zone in an amount sufficient to maintain an average oxygen level equivalent to about 0.6 to about 1.3 of a stoichiometric requirement for complete combustion of fuel and combustible material in the combustion chamber. In one embodiment of this invention, about 5% to about 30% of the flue gases from the boiler exhaust are recirculated back into the oxygen deficient secondary combustion zone. In another embodiment of this invention, another carrier fluid such as steam, water, or industrial grade nitrogen in an amount comprising about 1% to about 40% by weight of the total flue products from the furnace is injected into the oxygen deficient secondary combustion zone.

Vitiated air is ejected from above the burnout grate portion and injected into the combustion chamber, above the oxygen deficient secondary combustion zone. In one embodiment of this invention, the ejected vitiated air is mixed with fresh air or industrial grade oxygen prior to injection. Overfire air is supplied into the combustion chamber through at least one overfire air inlet above the oxygen deficient secondary combustion zone for thorough mixing and at least partial burnout of combustibles contained within the combustible material combustion products in a tertiary combustion zone, which is downstream of the oxygen deficient secondary combustion zone. In another embodiment according to this invention, overfire air representing about 5% to about 50% of a total air supply to the combustion chamber is injected above the oxygen deficient secondary combustion zone to provide an oxidizing zone.

In one embodiment of this invention, natural gas, recirculated flue gases, or a mixture of natural gas and recirculated flue gases or other carrier fluid is injected into the combustion chamber above the stoker grate and overfire air is injected downstream thereof. Any of the fluid streams can be tangentially or radially injected into the combustion chamber, or can be injected into the combustion chamber at an angle with respect to the horizontal.

A furnace or apparatus for combustion of solid combustible materials in accordance with the process of this invention includes a plurality of walls which define a combustion chamber. In one embodiment of the present invention, a stoker grate having at least one drying grate portion, at least one combustion grate portion, and at least one burnout grate portion is located in a lower portion of the combustion chamber. At least one ash pit is located downstream of the burnout grate portion, within the combustion chamber.

At least one solid combustible material inlet is located in at least one wall of the combustion chamber, in a position such that the combustible material is introduced into the combustion chamber on the drying grate portion. At least one conduit is in communication with an undergrate air source or a primary combustion air source and a space beneath the stoker grate and is used to supply undergrate air through the stoker grate, or through another combustion chamber design.

In one embodiment of this invention, at least one nozzle for injecting fuel, a fuel/carrier fluid mixture, or carrier fluid alone is sealably secured to at least one wall of and is in communication with an oxygen deficient secondary combustion zone within the combustion chamber, above the stoker grate. In a preferred embodiment, each of these nozzles is positioned such that the fluids are tangentially injected into the combustion chamber above the stoker, with respect to the combustion chamber walls. At least one overfire air nozzle is used to supply overfire air into the combustion chamber above the oxygen deficient secondary combustion zone. Each overfire air nozzle is sealably secured to the combustion chamber wall in a position such that the overfire air is injected into combustion products within the combustion chamber. In yet another preferred embodiment, each overfire air nozzle is positioned such that overfire air is also tangentially injected, with respect to the combustion chamber walls, into the combustion chamber above the oxygen deficient secondary combustion zone. Each overfire air nozzle is in communication with the combustion chamber.

In one embodiment, at least one overfire air nozzle for injecting vitiated air, a vitiated air/fresh air mixture or a vitiated air/industrial grade oxygen mixture is sealably secured to at least one wall of and is in communication with the combustion chamber above the oxygen deficient secondary combustion zone. In a preferred embodiment, each overfire air nozzle is positioned such that a fluid is tangentially or radially injected into the combustion chamber above the oxygen deficient secondary combustion zone, at an angle with respect to the horizontal. In yet another preferred embodiment, the fluid is tangentially injected, with respect to the combustion chamber walls, through the overfire air inlet into the combustion chamber above the oxygen deficient secondary combustion zone.

These and other objects and features of the invention will be more readily understood and appreciated from the description and drawings contained herein.

DESCRIPTION OF PREFERRED EMBODIMENTS

For purposes of this invention, $NO_x$ is oxides of nitrogen or nitrogen oxides, such as NO, $NO_2$, and $N_2O$; nitrogen bearing compounds are compounds such as HCN and $NH_3$ that can be oxidized to $NO_x$, in the presence of oxygen. The primary combustion zone is the zone in which combustion of the combustible material occurs, primarily in the vicinity immediately above the combustion grate. The secondary combustion zone is the volume of the combustion chamber downstream of the primary combustion zone into which products of combustion from the primary combustion zone flow. The tertiary combustion zone is the volume of the combustion chamber downstream of the secondary combustion zone into which derivative flue products from the secondary combustion zone flow. The term "combustible material" as used in this specification and in the claims means any suitable material which can be burned. However, without intending to limit its scope in any manner, "combustible material" used in the process and apparatus of this invention will typically be municipal solid waste (MSW), refuse derived fuel (RDF), and/or other comparable solid waste. It is conceivable that waste may also have glass, metal, paper and/or plastic material removed from the composition, such as in the case of RDF, and still be used as combustible material in the furnace of this invention. The term "carrier fluid" as used in this specification and claims means any fluid suitable for injection into a combustion chamber for enhancing mixing and improving temperature and composition uniformity within the combustion chamber. Without intending to limit its scope in any way, "carrier fluids" typically used in the process and apparatus of this invention are flue gases, steam, water, air and industrial grade nitrogen. Finally, the term "oxygen deficient" as used throughout this specification and in the claims means insufficient oxygen to promote the conversion of nitrogen bearing compounds to $NO_x$.

Figure 1:
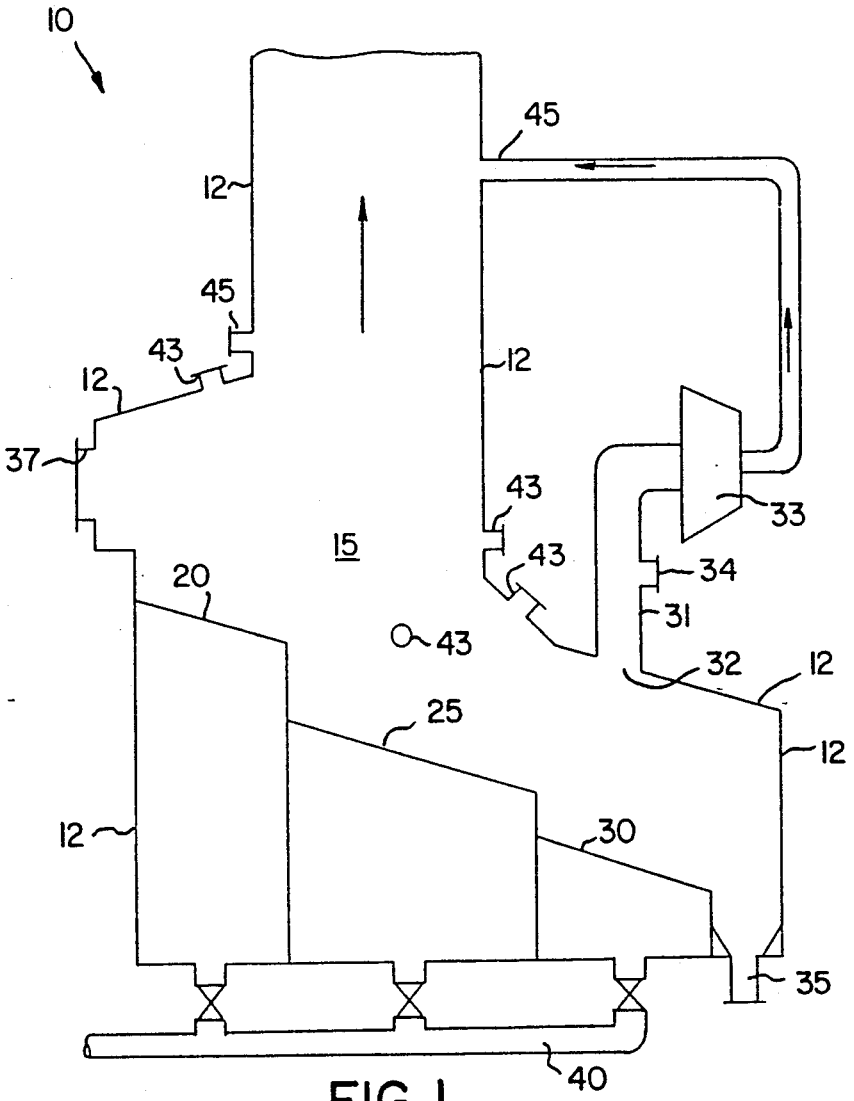
FIG. 1 shows a diagrammatic cross-sectional side view of a furnace for combustion of MSW or other solid combustible material, according to one embodiment of this invention.

The apparatus for combustion of combustible material in accordance with one embodiment of this invention, furnace 10, is shown in a diagrammatic cross-sectional side view in FIG. 1. A plurality of walls 12 define combustion chamber 15. A stoker grate positioned within combustion chamber 15, preferably in a lower portion thereof, comprises at least one drying grate portion 20, at least one combustion grate portion 25, and at least one burnout grate portion 30. At least one ash pit outlet 35 is located within combustion chamber 15, positioned to receive ash from burnout grate portion 30. At least one combustible material inlet means 37 is positioned in wall 12 above the grate such that the combustible material enters combustion chamber 15 and flows onto drying grate portion 20. The combustible material is advanced by combustible material advancement means from drying grate portion 20, over combustion grate portion 25, over burnout grate portion 30, and into ash pit outlet 35.

Undergrate air supply means comprises at least one undergrate air conduit 40 in communication with an undergrate air source and a space beneath at least one of drying grate portion 20, combustion grate portion 25, and burnout grate portion 30. Undergrate air conduit 40 is used to supply undergrate air beneath and then through the grate. An undergrate air source and at least one space beneath the stoker are in communication with undergrate air conduit 40 and are also used to provide undergrate air beneath and the through the grate. Undergrate air is the primary source of air for combustion of combustible material in combustion chamber 15. Combustion of the combustible material occurs in combustion chamber 15 primarily in the vicinity immediately above combustion grate portion 25, forming a primary combustion zone.

At least one fuel/carrier fluid nozzle 43 is secured to wall 12 and in communication with combustion chamber 15 Each fuel/carrier fluid nozzle 43 is positioned on wall 12 such that fuel/carrier fluids are injected into combustion products within combustion chamber 15. At least one overfire air nozzle 45 is sealably secured to wall 12 and in communication with combustion chamber 15. Each overfire air nozzle 45 is secured to wall 12 in such a position that a fluid, preferably vitiated air, is injected into combustion chamber 15, above the oxygen deficient secondary combustion zone. In a preferred embodiment according to this invention, each overfire air nozzle 45 and each fuel/carrier fluid nozzle 43 is either positioned or has internal mechanical components known in the art for tangentially or radially injecting each respective fluid into combustion chamber 15, above the oxygen deficient secondary combustion zone and the stoker grate, respectively. It is apparent that internal baffles, internal or external nozzles, or the like, can be used to tangentially or radially direct the fluid into combustion chamber 15. Thus, fluid swirl which enhances mixing can be accomplished in combustion chamber 15 having any type of cross section, even a rectangular cross section, as shown in FIG. 3.

Figure 2:
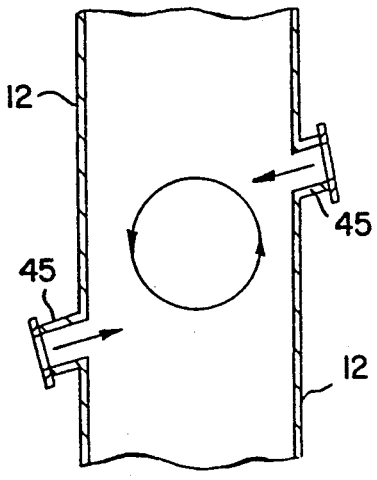
FIG. 2 shows a cross-sectional side view of an upper wall having nozzles secured at an angle with respect to the horizontal, according to one embodiment of this invention.
Figure 3:
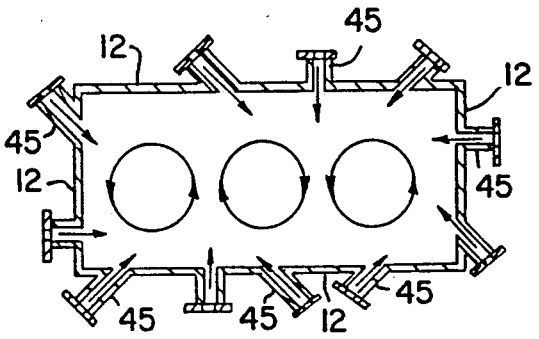
FIG. 3 shows a cross-sectional top view of the upper walls of the combustion chamber having secured nozzles that can be used to tangentially inject a gas, according to one embodiment of this invention.

Referring to FIG. 3, overfire air nozzles 45 can be positioned at angles relative to wall 12 such that at least one swirl, preferably multiple swirls, are formed within combustion chamber 15. It is apparent that the fluid can be injected into combustion chamber 15 at an angle with respect to the horizontal by positioning secondary air nozzle 45 at an angle with respect to the horizontal, as shown in FIG. 2.

In one embodiment of this invention, exhaust means for exhausting vitiated air from above burnout grate portion 30 comprises at least one induced draft fan 33 mounted within exhaust opening 32, preferably above burnout grate portion 30. Induced draft fan 33 is used to exhaust vitiated air from above burnout grate portion 30, within combustion chamber 15. In another embodiment of this invention, induced draft fan 33 and a discharge nozzle are used to inject vitiated air into combustion chamber 15, downstream of the oxygen deficient secondary combustion zone. In a preferred embodiment, the vitiated air is mixed with fresh air or industrial grade oxygen from a nitrogen/oxygen separator (not shown) injected through air inlet means 34 into vitiated air duct 31 and then the mixture is injected into combustion chamber 15 through overfire air nozzle 45, forming an oxidizing tertiary combustion zone downstream of the oxygen deficient secondary combustion zone. The temperature of the oxidizing tertiary combustion zone preferably is between about 1600° F. and about 2400° F. The amount of vitiated air and/or fresh air or industrial grade oxygen injected through overfire air nozzle 45 is sufficient to provide an oxygen concentration preferably of about 3% to about 12% within the oxidizing tertiary combustion zone.

Exhaust opening 32 can be positioned at any suitable location within wall 12, above burnout grate portion 30, preferably within the top section of wall 12, as shown in FIG. 1. Vitiated air duct 31 is sealably secured to wall 12 around exhaust opening 32. It is apparent that fan 33 can be a blower, a suction nozzle of a compressor, or any other type of suitable air compressing device or blower means.

In accordance with another embodiment of this invention, each of the hydrocarbon fuel, flue gases recirculated from the boiler section of the furnace and other carrier fluids is injected independently of each other into combustion chamber 15 and mixed therein to form an oxygen deficient secondary combustion zone.

In a process in accordance with this invention, combustible material is introduced through combustible material inlet 37 into combustion chamber 15 and onto drying grate portion 20 of the grate. The combustible material is further advanced, preferably by reciprocating motion and gravity over combustion grate portion 25 and burnout grate portion 30. Undergrate air is supplied beneath and then through drying grate portion 20, combustion grate portion 25 and burnout grate portion 30 for drying and combusting the combustible material. Ash products are removed from combustion chamber 15 through ash pit outlet 35 which is located downstream of burnout grate portion 30, within combustion chamber 15. Fuel is injected into combustion chamber 15 above the stoker grate to form an oxygen deficient secondary combustion zone of increased temperature for decomposing nitrogen bearing compounds as well as reducing $NO_x$ entering the oxygen deficient secondary combustion zone and improving combustible burnout downstream of the oxygen deficient secondary combustion zone. The fuel can be in either a solid, liquid or gaseous form, preferably containing insignificant amounts of fuel-bound nitrogen. In a preferred embodiment, the fuel is natural gas. The fuel represents about 5% to about 40% of the combustible material heating value. The fuel, either alone or mixed with recirculated flue gases and/or other carrier fluids, is injected through at least one fuel/carrier fluid nozzle 43, as shown in FIG. 1, to provide an average oxygen level equivalent to about 0.6 to about 1.3 of a stoichiometric requirement for complete combustion of combustible material and fuel within combustion chamber 15, above the stoker grate. Recirculated flue gases, representing about 5% to about 30% of the flue gases at the boiler exhaust, or other carrier fluid, such as steam, water, air, or industrial grade nitrogen in an amount preferably between about 5% and about 25% by weight of the total flue products from the furnace may be injected into the oxygen deficient secondary combustion zone to enhance mixing and improve temperature and gas composition uniformity.

In one embodiment of this invention, vitiated air is ejected from above burnout grate portion 30, mixed with fresh air or industrial grade oxygen at fresh air nozzle 34, and injected as overfire air into combustion chamber 15 above the oxygen deficient secondary combustion zone. The overfire air is preferably injected through at least one overfire air nozzle 45 secured to wall 12 and in communication with combustion chamber 15, above the oxygen deficient secondary combustion zone.

Overfire air is supplied into combustion chamber 15 through at least one overfire air nozzle 45 for thorough mixing and at least partial burnout of combustibles contained within the combustible material combustion products. In a preferred embodiment of this invention, overfire air is tangentially or radially injected, with respect to wall 12, into combustion chamber 15, above the oxygen deficient secondary combustion zone. In one embodiment of this invention, overfire air providing an oxygen concentration of about 3% to about 12% in an oxidizing tertiary combustion zone is injected above the oxygen deficient secondary combustion zone.

Residence times, preferably of about 1 to about 4 seconds, for combustion products within the oxygen deficient secondary combustion zone must be sufficient to permit decomposition of nitrogen bearing compounds and reduction of $NO_x$. The preferred residence time of about 1 to about b 4 seconds is due to the relatively low temperatures in waste combustors. However, it is apparent that the residence time may vary according to the specific combustible material, amount of fuel injected and the combustor operating temperature.

In another preferred embodiment according to this invention, the ejected vitiated air is mixed with fresh air prior to injection into combustion chamber 15, above the oxygen deficient secondary combustion zone. An oxygen level, relative to fuel and combustible materials, in the oxygen deficient secondary combustion zone in the combustion chamber is an amount equivalent to about 0.6 to about 1.3 of a stoichiometric requirement for complete combustion of said fuel and combustible materials and the oxygen concentration downstream of overfire air nozzle 45 is about 3% to about 12%. In another embodiment according to this invention, flue gas is recirculated for drying and preheating combustible material on the drying grate portion 20.

In still another preferred embodiment according to this invention, natural gas, carrier fluids, a natural gas/-carrier fluid mixture, and/or overfire air, all generally referred to as a fluid, can be tangentially or radially injected, with respect to wall 12, into combustion chamber 15, above the stoker. In another embodiment according to this invention, the fluid can be injected into combustion chamber 15 above the stoker grate, at an angle with respect to the horizontal, as shown in FIG. 2.

This invention uses a combination of low excess air or substoichiometric combustion of the combustible material on the stoker grate. Natural gas or any other solid, liquid, or gaseous fuel that, preferably, does not contain significant fuel-bound nitrogen and/or carrier fluid is injected into combustion chamber 15 above the stoker grate into an oxygen deficient secondary combustion zone in an amount sufficient to maintain an average oxygen level equivalent to about 0.6 and about 1.3 of the stoichiometric requirement for complete combustion of fuel and combustible materials above the stoker grate resulting in decomposition of nitrogen bearing compounds to $N_2$ and reduction in $NO_x$ formation Overfire air is injected above the oxygen deficient secondary combustion zone to provide a relatively strong mixing zone which assures high efficiency/low pollutant emission combustion within combustion chamber 15, providing low air emissions such as CO, THC, PCDD and PCDF.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for combustion of combustible material comprising the steps of:

(a) introducing the combustible material into a drying zone within a combustion chamber;

(b) supplying air to the drying zone for preheating, drying, and partially combusting the combustible material;

(c) advancing the combustible material to a combustion zone within the combustion chamber;

(d) supplying air to the combustion zone for further combusting the combustible material;

(e) advancing the combustible material to a burnout zone within the combustion chamber;

(f) supplying air to the burnout zone for final burnout of organics in the combustible material;

(g) removing ash from the combustion chamber;

(h) injecting at least one of a fuel and a carrier fluid selected from the group consisting of recirculated flue gases, steam, water, industrial grade nitrogen and mixtures thereof into the combustion chamber to create an oxygen deficient secondary combustion zone; and (i) injecting overfire air comprising an oxidizing fluid selected from the group consisting of vitiated air, fresh air, industrial grade oxygen and mixtures thereof into the combustion chamber for thorough mixing and final burnout of combustibles in combustion products of the combustible material in a tertiary combustion zone.

2. A process for combustion of combustible material according to claim 1 further comprising ejecting vitiated air from said burnout zone and mixing the ejected vitiated air with one of said fresh air and said industrial grade oxygen prior to injecting the ejected vitiated air into the combustion chamber.

3. A process for combustion of combustible material according to claim 1 further comprising maintaining, relative to said fuel and said combustible material, an oxygen level in the oxygen deficient secondary combustion zone in an amount equivalent to about 0.6 to about 1.3 of a stoichiometric requirement for complete combustion of said fuel and combustible materials.

4. A process for combustion of combustible material according to claim 1 further comprising maintaining an oxygen concentration downstream of overfire air inlet means of about 3% to about 12%.

5. A process for combustion of combustible material according to claim 1 further comprising injecting said fuel within the combustion chamber above the combustible material to provide the oxygen deficient secondary combustion zone for reducing at least nitrogen oxides.

6. A process for combustion of combustible material according to claim 5 wherein the fuel is at least one of a solid fuel, a liquid fuel and a gaseous fuel containing relatively insignificant fuel-bound nitrogen.

7. A process for combustion of combustible material according to claim 6 wherein the fuel is natural gas.

8. A process for combustion of combustible material according to claim 7 wherein the fuel represents about 5% to about 40% of a combustible material heating value and the fuel is injected into the combustion chamber to maintain within the oxygen deficient secondary combustion zone an average oxygen level in an amount equivalent to about 0.6 to about 1.3 of a stoichiometric requirement for complete combustion of said fuel and said combustible material.

9. A process for combustion of combustible material according to claim 1 further comprising injecting the overfire air above the oxygen deficient secondary combustion zone to provide an oxidizing zone.

10. A process for combustion of combustible material according to claim 9 wherein an oxygen concentration in said oxidizing zone is about 3% to about 12%.

11. A process for combustion of combustible material according to claim 1 wherein the air is adjusted to provide an average oxygen level in the oxygen deficient secondary combustion zone in an amount equivalent to about 0.6 to about 1.3 of a stoichiometric requirement for complete combustion of said fuel and said combustible material.

12. A process for combustion of combustible material according to claim 1 wherein the fuel provides, above the combustible material, an average oxygen level in an amount equivalent to about 0.6 to about 1.3 of a stoichiometric requirement for complete combustion of said fuel and said combustible material.

13. A process for combustion of combustible material according to claim 1 further comprising injecting at least one of said fuel, said carrier fluid, said overfire air, and said vitiated air above the combustible material at an angle with respect to a horizontal.

14. A process for combustion of combustible material according to claim 1 further comprising tangentially injecting, with respect to a combustion chamber wall, above the combustible material at least one of said fuel, said carrier fluid, said overfire air and said vitiated air.

15. A process for combustion of combustible material according to claim 1 further comprising tangentially injecting, with respect to a combustion chamber wall, said overfire air into the combustion chamber above the oxygen deficient secondary combustion zone.

16. A process for combustion of combustible material comprising the steps of:

(a) introducing the combustible material into a combustion chamber and onto a drying grate portion of a stoker grate;

(b) supplying air to the drying grate portion for preheating, drying and partially combusting the combustible material;

(c) advancing the combustible material to a combustion grate portion of the stoker grate, within the combustion chamber;

(d) supplying air to the combustion grate portion for further combusting the combustible material;

(e) advancing the combustible material to a burnout grate portion of the stoker grate, within the combustion chamber;

(f) supplying air to the burnout grate portion for final burnout of organics in the combustible material;

(g) removing ash from the combustion chamber;

(h) injecting at least one of a fuel and a carrier fluid selected from the group consisting of recirculated flue gases, steam, water, industrial grade nitrogen and mixtures thereof above a primary combustion zone to create an oxygen deficient secondary combustion zone within the combustion chamber; and (i) injecting overfire air comprising an oxidizing fluid selected from the group consisting of vitiated air, fresh air, industrial grade oxygen and mixtures thereof into the combustion chamber above the oxygen deficient secondary combustion zone for thorough mixing and final burnout of combustibles in combustion products of the combustible material in a tertiary combustion zone.

17. A process for combustion of combustible material according to claim 16 further comprising ejecting vitiated air from above said burnout grate portion and mixing the ejected vitiated air with one of said fresh air and said industrial grade oxygen prior to injecting the ejected vitiated air into the combustion chamber.

18. A process for combustion of combustible material according to claim 16 further comprising maintaining relative to said fuel and said combustible material in the combustion chamber an average oxygen level in the oxygen deficient secondary combustion zone in an amount equivalent to about 0.6 to about 1.3 of a stoichiometric requirement for complete combustion of said fuel and combustible materials.

19. A process for combustion of combustible material according to claim 16 further comprising maintaining an oxygen concentration downstream of overfire air inlet means of about 3% to about 12%.

20. A process for combustion of combustible material according to claim 16 further comprising injecting said fuel within the combustion chamber above the stoker grate to provide the oxygen deficient secondary combustion zone for reducing at least nitrogen oxides.

21. A process for combustion of combustible material according to claim 20 wherein the fuel is at least one of a solid fuel, a liquid fuel and a gaseous fuel containing relatively insignificant fuel-bound nitrogen.

22. A process for combustion of combustible material according to claim 20 wherein the fuel is natural gas.

23. A process for combustion of combustible material according to claim 20 wherein the fuel represents about 5% to about 40% of a combustible material heating value and the fuel is injected into the combustion chamber to maintain in the oxygen deficient secondary combustion zone an average oxygen level in an amount equivalent to about 0.6 to about 1.3 of a stoichiometric requirement for complete combustion of said fuel and said combustible material.

24. A process for combustion of combustible material according to claim 16 further comprising injecting the overfire air above the oxygen deficient secondary combustion zone to provide an oxidizing zone.

25. A process for combustion of combustible material according to claim 24 wherein an oxygen concentration is said oxidizing zone is about 3% to about 12%.

26. A process for combustion of combustible material according to claim 16 wherein the air is adjusted to provide in the oxygen deficient secondary combustion zone an average oxygen level in an amount equivalent to about 0.6 to about 1.3 of a stoichiometric requirement for complete combustion of said fuel and said combustible material.

27. A process for combustion of combustible material according to claim 16 wherein the fuel provides an average oxygen level above the stoker grate in an amount equivalent to about 0.6 to about 1.3 of a stoichiometric requirement for complete combustion of said fuel and said combustible material.

28. A process for combustion of combustible material according to claim 16 further comprising injecting at least one of said fuel, said carrier fluid, said overfire air, and said vitiated air above the stoker grate at an angle with respect to a horizontal.

29. A process for combustion of combustible material according to claim 16 further comprising tangentially injecting, with respect to a combustion chamber wall, above the stoker grate at least one of said fuel, said carrier fluid, said overfire air and said vitiated air.

30. A process for combustion of combustible material according to claim 16 further comprising tangentially injecting, with respect to a combustion chamber wall, said overfire air into the combustion chamber above the oxygen deficient secondary combustion zone.

* * * * *